US007950894B2

(12) United States Patent
Rossi et al.

(10) Patent No.: US 7,950,894 B2
(45) Date of Patent: May 31, 2011

(54) ADJUSTABLE OPERATOR INTERFACE

(75) Inventors: Michael C. Rossi, Cary, NC (US); Kevin E. Pielmeier, Cary, NC (US)

(73) Assignee: Caterpillar SARL, Geneva (CH)

( * ) Notice: Subject to any disclaimer, the term of this patent is extended or adjusted under 35 U.S.C. 154(b) by 620 days.

(21) Appl. No.: 11/492,726

(22) Filed: Jul. 25, 2006

(65) Prior Publication Data

US 2008/0023206 A1 Jan. 31, 2008

(51) Int. Cl.
*B66F 11/00* (2006.01)

(52) U.S. Cl. ..... 414/694; 414/686

(58) Field of Classification Search ..... 172/273; 296/72–73; 414/694, 723, 686
See application file for complete search history.

(56) References Cited

U.S. PATENT DOCUMENTS

| | | | | | |
|---|---|---|---|---|---|
| 214,505 | A | * | 4/1879 | Gwinn | 296/73 |
| 657,858 | A | * | 9/1900 | Jaquet | 4/255.12 |
| 3,003,651 | A | * | 10/1961 | Holopainen | 414/694 |
| 3,680,724 | A | * | 8/1972 | Schaeff | 414/694 |
| 3,710,904 | A | * | 1/1973 | Boyer et al. | 192/219.7 |
| 3,732,996 | A | | 5/1973 | Bauer | |
| 3,844,425 | A | * | 10/1974 | Bailey | 414/686 |
| 3,984,016 | A | * | 10/1976 | Kuhn | 414/686 |
| 4,034,998 | A | * | 7/1977 | Iijima et al. | 280/461.1 |
| 4,117,944 | A | | 10/1978 | Beckstrom et al. | |
| 4,142,642 | A | * | 3/1979 | Myers | 414/719 |
| 4,150,504 | A | * | 4/1979 | Asche | 37/403 |
| 4,236,344 | A | * | 12/1980 | Kelly | 446/180 |
| 4,397,603 | A | | 8/1983 | Kraske et al. | |
| 4,419,040 | A | | 12/1983 | Pedersen et al. | |
| 4,741,663 | A | | 5/1988 | Kennedy | |
| 4,921,392 | A | * | 5/1990 | Wagner | 414/695 |
| 5,004,398 | A | | 4/1991 | Wagner et al. | |
| 5,171,124 | A | | 12/1992 | Foster | |
| 5,203,153 | A | * | 4/1993 | Van Zee et al. | 56/341 |
| 5,240,366 | A | * | 8/1993 | Bamford | 414/686 |
| 5,606,809 | A | | 3/1997 | Allen | |
| 6,019,332 | A | * | 2/2000 | Sweere et al. | 248/284.1 |
| 6,068,295 | A | * | 5/2000 | Skabrond et al. | 280/775 |
| 6,520,593 | B2 | * | 2/2003 | Dvorak et al. | 299/39.5 |
| 6,581,704 | B2 | * | 6/2003 | Law et al. | 180/6.32 |
| 6,643,577 | B1 | * | 11/2003 | Swick et al. | 701/50 |
| 6,725,583 | B2 | * | 4/2004 | Sprinkle et al. | 37/468 |
| 7,032,703 | B2 | * | 4/2006 | Wulfert et al. | 180/329 |
| 7,484,587 | B2 | * | 2/2009 | Portscheller et al. | 180/329 |
| 2009/0107015 | A1 | * | 4/2009 | Sakada et al. | 37/440 |

OTHER PUBLICATIONS

John Deere Worksite Pro Attachments: Backhoe, [online], (retrieved on Jul. 24, 2006) Retrieved from the construction equipment database of the John Deere website using internet <URL: http://www.deere.com>.

Bradco Backhoes & Accessories Product Brochure, [online], (retrieved on Jul. 24, 2006) Retrieved from the products database of the Bradco website using internet <URL: http.www.get-attached.com>.

(Continued)

*Primary Examiner* — Saúl J Rodríguez
*Assistant Examiner* — Joshua I Rudawitz
(74) *Attorney, Agent, or Firm* — William A. Beckman; Miller, Matthias & Hull

(57) ABSTRACT

An implement for a machine is provided. The implement has a frame, an operator interface, and a ratchet. The operator interface is pivotally attached to the frame about an axis. The ratchet is mounted about the axis and coupled to the frame and the operator interface.

5 Claims, 3 Drawing Sheets

OTHER PUBLICATIONS

Bobcat Backhoe Attachment, [online], (retrieved on Apr. 25, 2006) Retrieved from the Bobcat website using internet <URL: http://www.bobcat.com>.

Bobcat Bob-Tach Backhoe Attachment, [online], (retrieved on Apr. 25, 2006) Retrieved from the Bobcat website using internet <URL: http://www.bobcat.com>.

ASV Product Bulletin: 8-foot Quick-Attach Backhoe for use on ASV RC-50 Rubber Track Loader, Oct. 2005 [online], (retrieved on Jun. 16, 2004) Retrieved from the ASV website using internet <URL: http://www.asvi.com>.

ASV Product Bulletin: 7-foot Quick-Attach Backhoe for use on ASV RC-30 All Surface Loader, Jul. 2003, [online], (retrieved on Jun. 16, 2006) Retrieved from the ASV website using internet <URL: http://www.asvi.com>.

ASV Product Bulletin: 8-foot Quick-Attach Backhoe for use on ASV RC-50 and R-50 All Surface Loader, Jul. 2003 [online], (retrieved on Jun. 16, 2004) Retrieved from the ASV website using internet <URL: http://www.asvi.com>.

ASV Product Bulletin: 9'-11' Extendible Quick-Attach Backhoe for use on RC-100 All Surface Loader, Nov. 2003, [online], (retrieved on Jun. 16, 2004) Retrieved from the ASV website using internet <URL: http://www.asvi.com>.

ASV Product Bulletin: 8-foot Quick-Attach Backhoe for use on RC-60 Rubber Track Loader, May 2004, [online], (retrieved on Jun. 16, 2004) Retrieved from the ASV website using internet <URL: http://www.asvi.com>.

* cited by examiner

ADJUSTABLE OPERATOR INTERFACE

TECHNICAL FIELD

This invention relates generally to an adjustable operator interface, and more particularly, to an adjustable operator interface for a removable implement mounted to a machine such as a skid steer loader.

BACKGROUND

Machines such as skid steer loaders, integrated tool carriers, backhoe loaders, excavators, and a wide variety of other machines generally have a plurality of hydraulically controlled implements that may be interchangeably attached to perform a particular work function. Typically, an operator controls these implements through the machine's standard operator interface. However, the standard operator interface may not be particularly suited for handling implements with more complex functions, such as a backhoe attachment having a sideshift, extendable stick, or center pivot function. Due to the need to control additional hydraulic circuits, an operator may require an interface having additional control levers, joysticks, buttons, etc.

Removable implements having operator interfaces have been disclosed, for example, in U.S. Pat. No. 5,004,398 to Wagner ("Wagner"). The removable implement disclosed in Wagner provides for a separate operator interface for operating the backhoe attachment. However, this interface requires that the operator control the implement while on an operator's chair outside of the machine's cab, and also requires an additional seat.

U.S. Pat. No. 4,117,944 to Beckstrom ("Beckstrom") provides for a backhoe mounting assembly that permits the operator to control the implement while within the confines of the cab. However, the implement shown in Beckstrom uses the machine interface to control the implement. As mentioned above, the machine's standard interface may not be particularly suited for handling implements with more complex functions, requiring additional control levers and hydraulic lines.

The present invention is directed to overcome one or more of the problems as set forth above.

SUMMARY OF THE INVENTION

In one aspect of the present invention, an implement for a machine is provided. The implement has a frame, an operator interface, and a ratchet. The operator interface is pivotally attached to the frame about an axis. The ratchet is mounted about the axis and coupled to the frame and the operator interface.

In another aspect of the present invention, a machine has at least one lift arm, an implement, and a ratchet. The implement is removably attached to the at least one lift arm. The implement also has a frame and an operator interface pivotally attached to the frame about an axis. The ratchet is mounted about the axis and coupled to the frame and the operator interface.

A third aspect of the present invention includes a method of providing an implement for a machine. The method includes the step of providing a frame. The method also includes the step of pivotally attaching an operator interface to the frame about an axis. The method also includes the step of mounting a ratchet about the axis and coupling the ratchet to the frame and operator interface.

DETAILED DESCRIPTION

Figure 1:
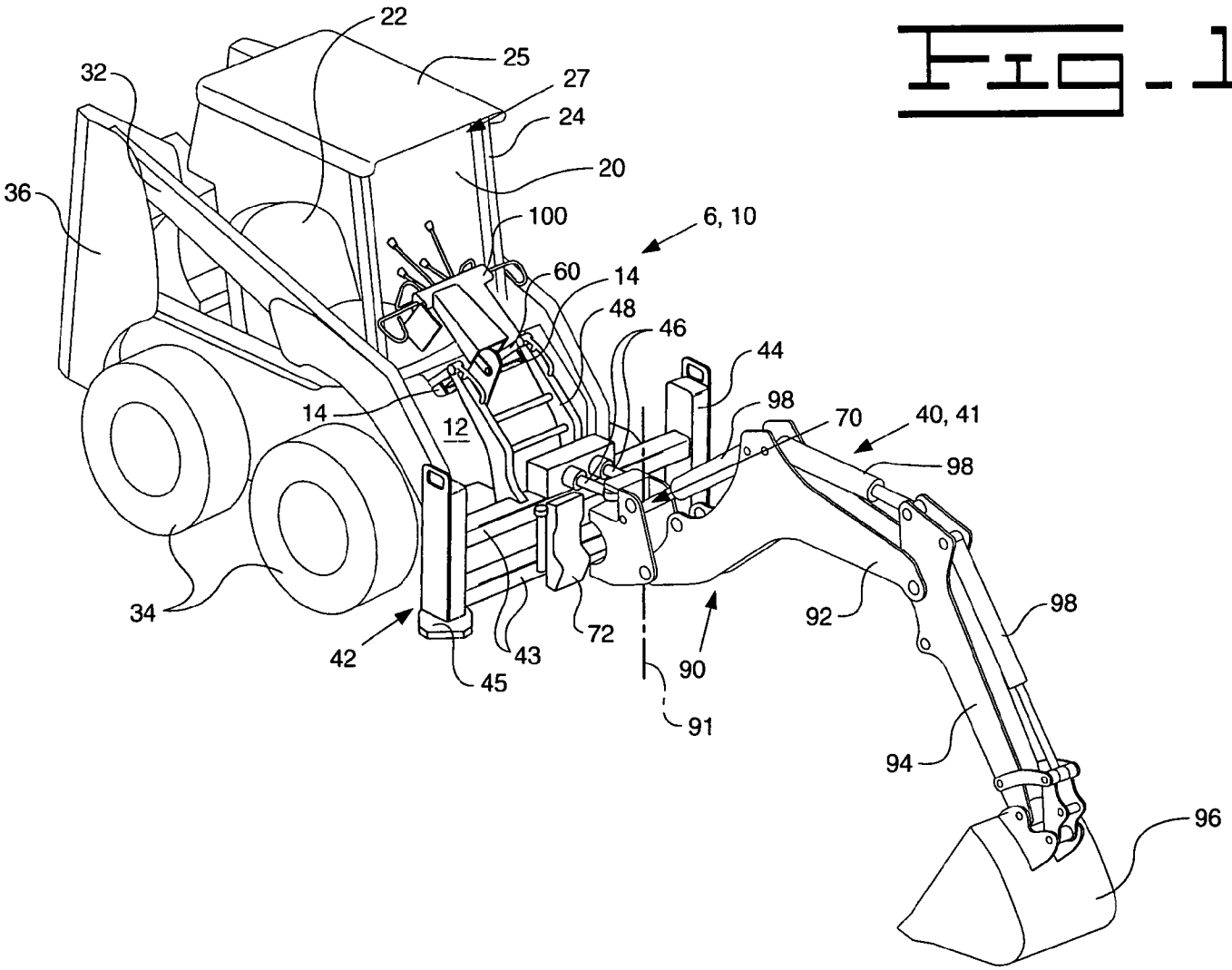
FIG. 1 is a diagrammatic illustration of a machine having an implement with an adjustable operator interface.

A machine 6 such as a skid steer loader 10 in accordance with the present invention is illustrated in FIG. 1. As shown, the skid steer loader 10 includes a body portion 12, steps 14, an operator compartment 20, and a lift arm assembly 32. Front and rear sets of wheels 34 are mounted to stub axles (not shown) that extend from each side of the body portion 12. The lift arm assembly 32 is pivotally mounted to laterally spaced side members or uprights 36 at the rear of the body portion 12 and pivotally carries an implement 40 via a coupler (not shown). It should be recognized that the skid steer loader 10 could be belt/track driven or could have a belt entrained around front and rear wheels 34.

The operator compartment 20 may include a rollover protective structure (ROPS) and/or a falling object protective structure (FOPS) enclosing an operator seat 22. A pair of posts 24 and an overhead guard 25 may define an opening 27 into the operator compartment 20. An optional door (not shown) may also be mounted to opening 27. The operator compartment 20 also includes an integral operator interface (not shown) in proximity to the seat 22 for controlling the wheels 34 for propelling the vehicle and the lift arm assembly 32.

In FIG. 1, the implement 40 is depicted as a backhoe attachment 41 removably attached to the skid steer loader 10. The implement includes a frame 42, an adjustable operator interface 100, a sideshift assembly 70, and a linkage 90 having a boom 92, stick 94, and bucket 96 driven by hydraulic actuators 98. The frame 42 is removably attached to the skid steer loader 10 through the coupler (not shown), forming a primary attachment. In addition, a pair of beams 48 extends from the frame 42 and terminates in a pair of hook assemblies 60 through a clevis arrangement. The hook assemblies 60 are hooked onto the steps 14 of the skid steer loader 10 and provide a secondary attachment. This secondary attachment also restrains the lift arm assembly 32 and coupler (not shown) against the skid steer loader 10 when an operator operates the implement 40.

As seen in FIG. 1, the sideshift assembly 70 is mounted to the frame 42 through a carrier 72. The carrier 72 is slidably mounted to a plurality of transverse rails 43 in the frame 42. The transverse rails 43 are connected to a pair of struts 44 that support the implement 40. Each of the struts 44 has an adjustable footpad 45 to level the implement 40. In addition, actuators 46 may rotate the linkage 90 about a vertical axis 91, pivoting it left and right with respect to the skid steer loader 10.

Figure 2:
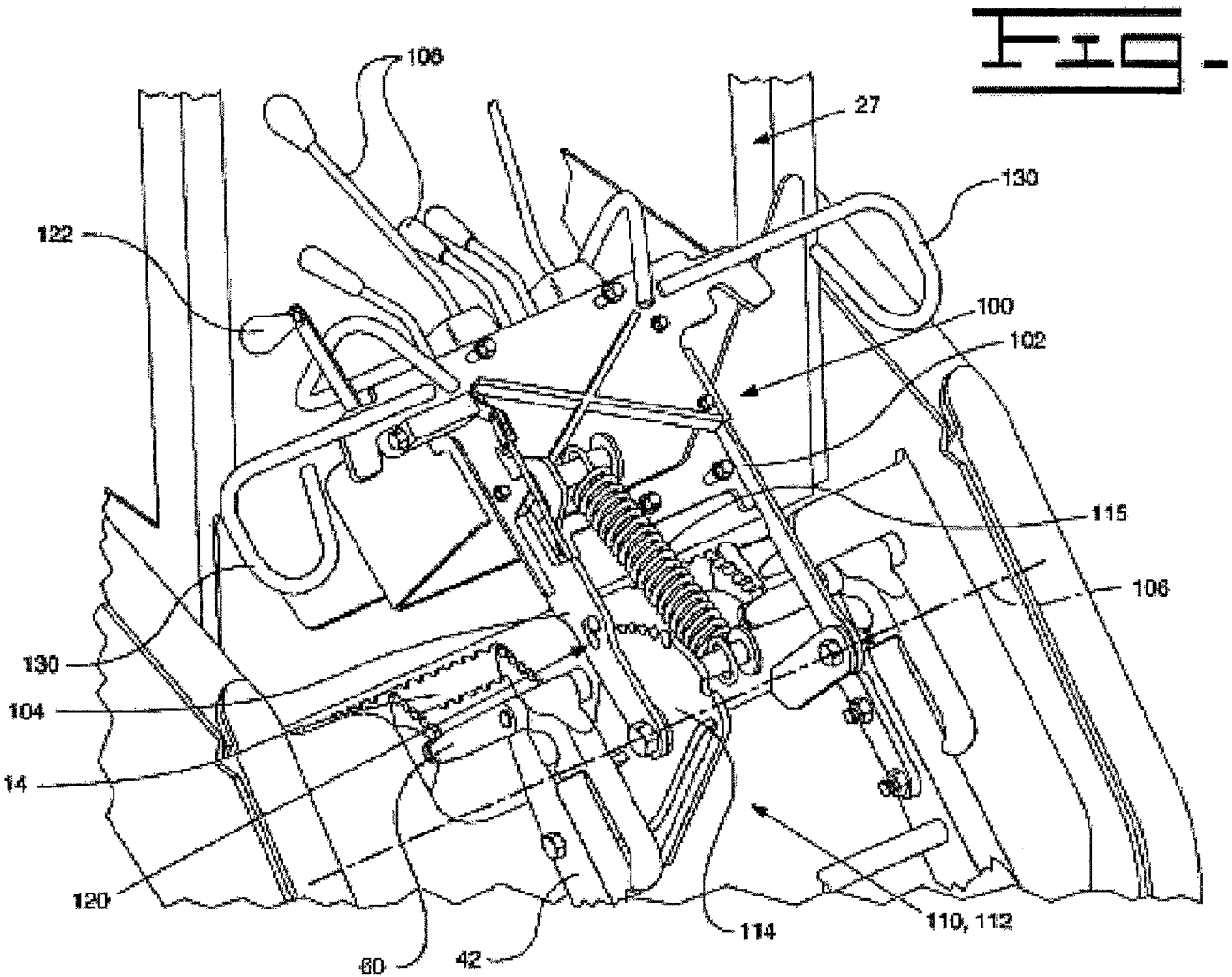
FIG. 2 is a detail view of the adjustable operator interface of FIG. 1.

As seen in FIG. 2, the adjustable operator interface 100 is adjustably attached to the frame 42. A first and a second support member 102, 104 pivotally attach the adjustable operator interface 100 to the frame 42 about a pivot axis 106. A rotational locking member 110 rotationally secures the adjustable operator interface 100 with respect to the frame 42, and is coupled to the adjustable operator interface 100 and the frame 42. The interface 100 also includes at least one control lever 108 for controlling the actuators 46. While FIG. 2 illustrates the control lever 108 as a lever, joysticks or other interfaces may also be used. Hydraulic lines (not shown) connect the adjustable operator interface 100 to the actuators 46, 98. The adjustable operator interface 100 may also include at least one handle 130. The handle 130 extends laterally from the adjustable operator interface 100 and extends beyond the opening 27. Operator interface 100 may alternately have at least one projection that extends beyond the opening 27 in place of the at least one handle 130.

The rotational locking member 110 is illustrated as a ratchet 112 in FIG. 2, including a ratchet wheel 114, a pawl assembly 120, and a spring 115. The ratchet wheel 114 is attached to the frame 42, and the pawl assembly 120 is attached to the adjustable operator interface 100, with the spring 115 biasing the adjustable operator interface 100 towards the frame 42. The ratchet wheel 114 may be alternately attached to the adjustable operator interface 100, and the pawl assembly 120 attached to the frame 42. In addition, the rotational locking member 110 may use a spring-loaded detent, manual locking knob, or any other rotational locking device known in the art.

Figure 3:
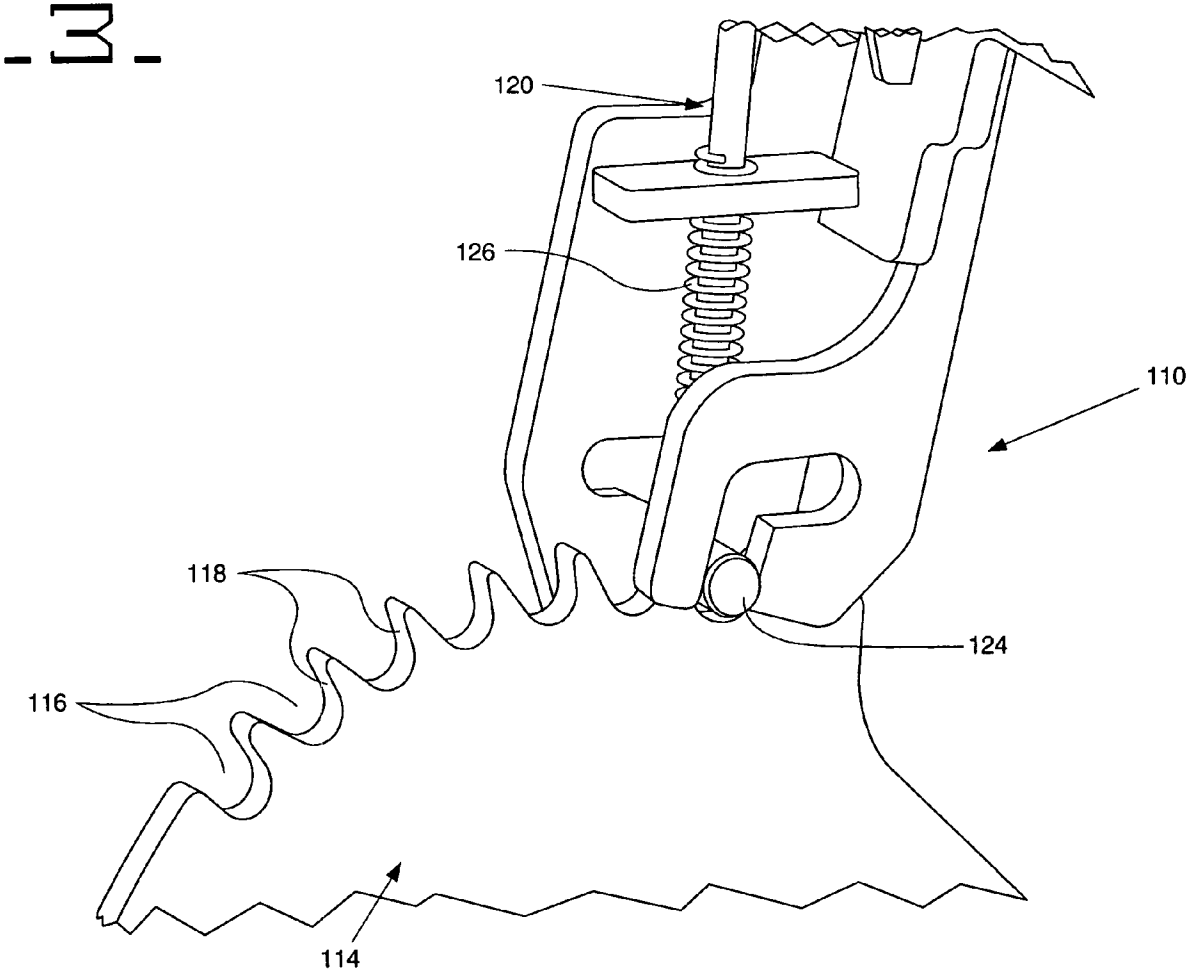
FIG. 3 is a detail view of a ratchet of the adjustable operator interface of FIG. 1.

As seen in FIG. 3, the ratchet wheel 114 includes a plurality of slots 116. The slots 116 are have angled ramps 118 to allow the adjustable operator interface 100 to be freely rotated away from the operator compartment 20. The pawl assembly 120 includes a release lever 122 (seen in FIG. 2), a pawl 124, and a spring 126. The spring 126 biases the pawl 124 into engagement with a slot 116 in the ratchet wheel 114. Actuating the release lever 122 pulls the pawl 124 towards the adjustable operator interface 100 and out of engagement with the ratchet wheel 114, allowing the adjustable operator interface 100 to be freely rotated about the pivot axis 106.

INDUSTRIAL APPLICABILITY

An operator may enter the operator compartment or cab 20 by climbing up steps 14, and lifting the adjustable operator interface 100 by the handle 130. This causes the pawl 124 to ride along the angled ramp 118 of a slot 116, disengaging the pawl assembly 120 from the ratchet wheel 114 and allowing the adjustable operator interface 100 to rotate about the pivot axis 106. After an operator has entered the operator compartment 20, the operator may actuate the release lever 122. The actuation of the release lever 122 disengages the pawl 124 from engagement with the slots 116 of the ratchet wheel 114, allowing the adjustable operator interface 100 to be rotated downward toward the operator compartment 20 about the pivot axis 106. When the operator releases the release lever 122, the spring 126 biases the pawl 124 into engagement with a slot 116 in the ratchet wheel 114, locking the downward rotation of the adjustable operator interface 100 about the pivot axis 106. The handle 130 projects laterally from the adjustable operator interface 100, extending beyond the opening 27 of the operator compartment 20 and serving to stop the adjustable operator interface 100 from entering the operator compartment 20.

Once an operator is in the operator compartment 20 and has the adjustable operator interface 100 positioned properly, the operator may sit in the seat 22 and use the control levers 108 to control the actuators 46, 98, which in turn control the actuation of the boom 92, stick 94, bucket 96, and sideshift or pivot features. In this position, the operator may operate the implement 40 using the adjustable operator interface 100 while remaining within the protective confines of the provided ROPS or FOPS.

Several advantages over the prior art may be associated with the adjustable operator interface 100. The ratchet 112 may allow for an operator to more easily position the adjustable operator interface 100 to enter or exit the operator compartment 20, and may also allow an operator to ergonomically position the control lever 108.

Other aspects, objects and advantages of this invention can be obtained from a study of the drawings, the disclosure, and the appended claims.

What is claimed is:

1. A machine, comprising:

a vehicle comprising:

a body portion;

at least one step extending from the body portion;

at least one lift arm; and a cab having an opening having a width; and an implement removably attached to the at least one lift arm, the implement having a frame, an operator interface pivotally attached to the frame of the implement about an axis, at least one hook assembly mounted on the frame, the hook assembly removably attached to the at least one step and a ratchet mounted about the axis and coupled between the frame and the operator interface, wherein the operator interface has at least one handle extending substantially parallel to the axis beyond the width of the opening into the cab.

2. The machine of claim 1, wherein the machine is a skid steer loader.

3. The machine of claim 2, wherein the implement is a backhoe attachment.

4. The machine of claim 1, wherein the ratchet includes a ratchet wheel attached to the frame and a pawl attached to the operator interface.

5. The machine of claim 1, wherein the operator interface includes at least one control lever configured to be located at least partially within the cab when the operator interface is rotated about the axis towards the cab.

* * * * *